United States Patent [19]

Larson

[11] 3,981,757

[45] Sept. 21, 1976

[54] METHOD OF FABRICATING KEYBOARD APPARATUS

[75] Inventor: Willis August Larson, Mequon, Wis.

[73] Assignee: Globe-Union Inc., Milwaukee, Wis.

[22] Filed: Apr. 14, 1975

[21] Appl. No.: 567,874

[52] U.S. Cl. ..... 156/8; 29/625; 156/250; 200/5 A; 427/96

[51] Int. Cl.[2] ..... C23F 1/02

[58] Field of Search ..... 29/625; 200/5 A, 5 D, 200/5 E, 267, 268, 269, 275, 278, 292; 156/3, 8, 18, 250; 96/36.2; 427/96, 258, 259, 265, 282, 266, 269, 287

[56] References Cited

UNITED STATES PATENTS

| | | | |
|---|---|---|---|
| 2,616,994 | 11/1952 | Luhn | 200/11 |
| 2,699,424 | 1/1955 | Nieter | 156/3 X |
| 3,200,210 | 8/1965 | Alonas et al. | 200/292 X |
| 3,822,467 | 7/1974 | Symersky | 29/579 |
| 3,833,375 | 9/1974 | Moscony et al. | 156/8 X |
| 3,866,310 | 2/1975 | Driver et al. | 29/571 |

*Primary Examiner*—William A. Powell

*Attorney, Agent, or Firm*—James L. Kirschnik; John Phillip Ryan

[57] ABSTRACT

A method of forming an insulator and electrode member is disclosed, in its preferred form, as including an insulator having a first face supporting a uniform height conductive layer. A plurality of first electrode members are formed in the conductive layer by etching away or otherwise forming an array of apertures therein. A plurality of second electrode members are simultaneously formed either by printing, screening or other similar approach forming conductive material within and laterally spaced from the array of apertures.

23 Claims, 3 Drawing Figures

METHOD OF FABRICATING KEYBOARD APPARATUS

BACKGROUND

The present invention relates generally to switches, specifically to switches actuated by touch and more particularly to insulator and electrode members for use in keyboard apparatus.

Increasing interest in electronic apparatus having switch keyboards, such as calculators, typewriters, and similar apparatus, has increased the need for keyboard apparatus. Such keyboard apparatus should include insulator and electrode members which can be easily manufactured at low cost and which lend themselves to mass production techniques which reduce expenses for materials and labor.

SUMMARY

The method of the present invention solves the above and other problems in keyboard apparatus by providing a method of forming the electrode members on an insulator including the steps of obtaining an insulator having a first face supporting a uniform conductive layer; forming the plurality of first electrode means in the entire thickness of the conductive layer to expose areas of the first face of the insulator; and simultaneously forming a plurality of second electrode members within the exposed areas of the first insulator, the thickness of the plurality of second electrode members being unequal to the thickness of the conductive layers supported on the insulator.

A preferred apparatus from this method is shown as an insulator and electrode member for use in an electronic keyboard switch including a plurality of first electrode members and a plurality of second electrode members forming an array of individual switching units on a face of an insulator. The level of the top surface of the plurality of first electrode members is vertically spaced from the level of the top surface of the plurality of second electrode members.

It is a primary object of the present invention to provide novel methods for fabricating electrode members on an insulator.

It is an object of the present invention to provide methods useable with mass production techniques.

It is another object of the present invention to provide through such methods apparatus of simple design, easily manufactured, and efficiently utilizing the materials used.

These and further objects and advantages of the present invention will become clearer in the light of the following detailed description of an illustrative embodiment of this invention described in connection of the drawing.

The figures are drawn for ease of explanation of the basic teachings of the present invention only; the extensions of the figures with respect to number, position, relationship, and dimensions of the parts to form a preferred embodiment will be explained or will be within the skill of the art. Exact dimensions and dimensional proportions to conform to specific force, weight, strength, and similar requirements will likewise be within the skill of the art.

DESCRIPTION

Figure 1:
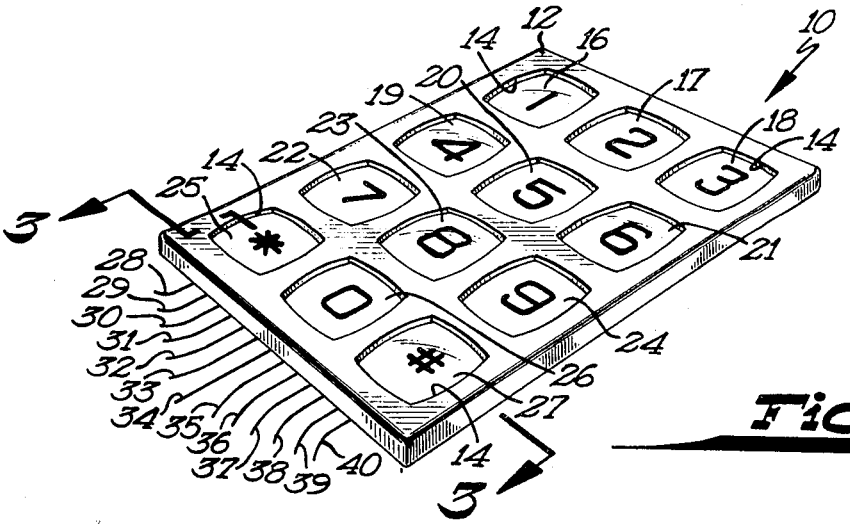
FIG. 1 shows a perspective view of a keyboard apparatus using an insulator and electrode member made according to the present invention.

In FIG. 1, a preferred form of a keyboard apparatus is generally designated 10. Keyboard 10 includes a plastic molding or bezel member 12 having a plurality of apertures 14 formed therein exposing an array of individual switching units 16–27 therethrough. Switching units 16–27 are actuable by an input signal from the touch of a user and provide an electrical output signal, through electrical leads 28–40, for use with electric circuits, not specifically shown. Switching units 16–27 of switch 10 may be of the type shown and disclosed in U.S. Pat. Nos. 3,737,670; 3,879,593; or an application for Letters Patent "Membrane Keyboard Apparatus," Ser. No. 564,912, filed on Apr. 3, 1975, all of which were filed in the name of the present inventor.

Figure 2:
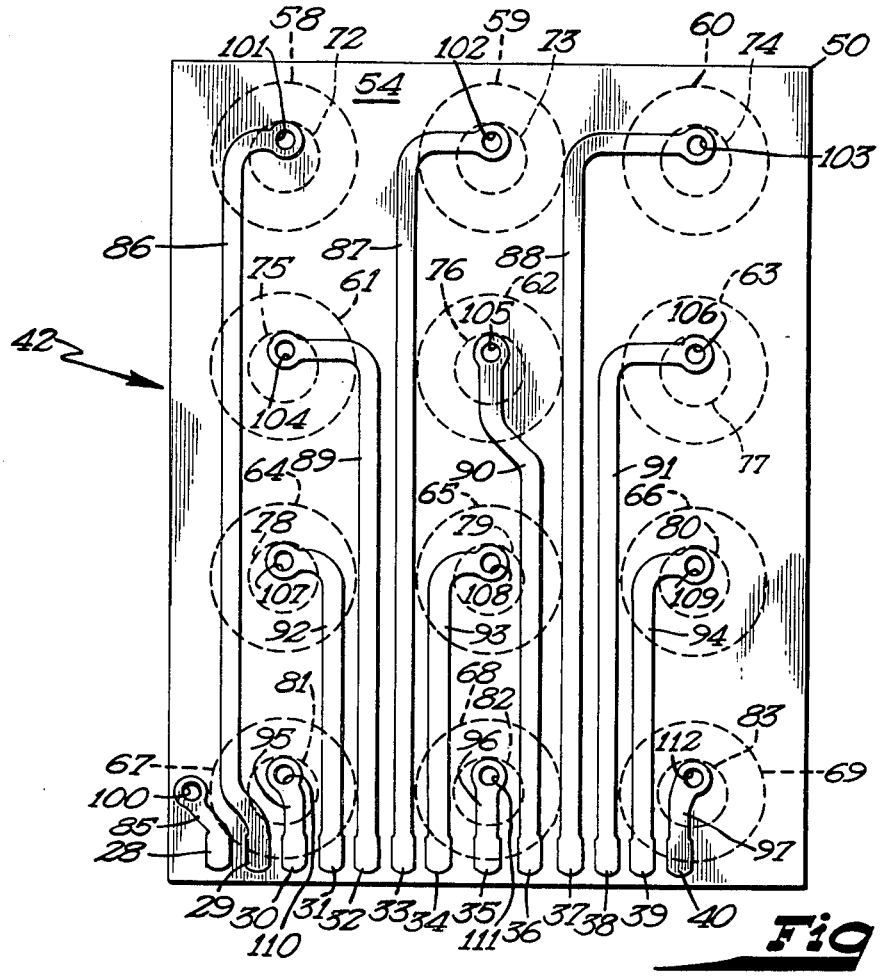
FIG. 2 is a mirror image of a bottom view of the apparatus of FIG. 1.
Figure 3:
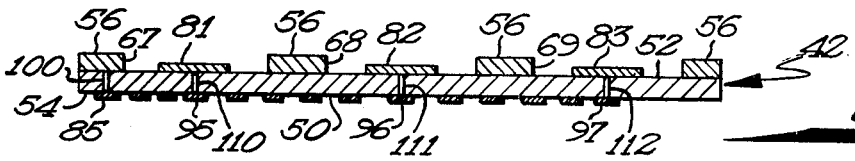
FIG. 3 is a partial cross sectional view of the insulator and electrode members of the apparatus of FIG. 1 along the planes of lines 3—3 of FIG. 1.

Switch 10 includes an insulator component, illustrated in FIGS. 2 and 3 and generally designated 42. Insulator component 42 includes an insulator 50 having a first, top surface or face 52 and a second, bottom surface or face 54, a conductive sheet 56 of substantial area covering the first face 52 having an array of apertures 58–69 formed therethrough to thus expose portions or areas of face 52. The material of conductive sheet 56 located around apertures 58–69 form a plurality of first electrode members which are electrically connected to each other by the remaining material of sheet 56. Insulator component 42 supports a plurality of second electrode members 72–83 located on face 52 concentrically within and spaced from the periphery of apertures 58–69 in sheet 56. The second electrode members 72–83 are electrically insulated from sheet 56, or from the first electrode members.

Printed conductors 85–97 are formed on bottom surface 54 of insulator 50. Leads 28–40 are electrically interconnected to printed conductors 85-97 by suitable means such as by soldering.

In the preferred embodiment, insulator 50 is of a thickness substantially equal to 0.062 inches (0.15748 centimeters). The thickness of conductive sheet 56 and electrode members 72–83 is substantially equal to between 2 and 5 mils (0.00508 and 0.01270 centimeters.)

As best seen in FIG. 3, the thickness or height of second electrode members 72–83 is less than the thickness or height of sheet 56 and hence the thickness or height of the first electrode members.

Second electrode members 72–83 are electrically interconnected to printed conductors 86–97, respectively, located on bottom surface 54 by electrical connections 101–112, respectively, which pass through insulator 50. Sheet 56 is electrically connected to printed conductor 85 located in bottom surface 54 by electrical connections 100 which passes through insulator 50.

Electrical connections 100–112 can be formed by any suitable method such as filling hole through insulator 50 interconnecting sheet 56 and electrode members 72–83, respectively with solder, sucking conductive paste therethrough, by plating through the holes, by pin members which pass through the insulator 50, or by other methods.

In the preferred embodiment, individual switching unit 16 includes: a first electrode member formed by the material located around or surrounding aperture 58 in sheet 56 which is electrically interconnected to lead 28 by electrical connection 100 and conductor 85; and second electrode member 72 which is electrically interconnected to lead 29 by electrical connection 101 and conductor 86. The electrode members of the remaining individual switching units 17–27 are similarly formed by apertures 59–69 of sheet 56 and electrode members 73–83.

The preferred method of forming the plurality of first and second electrode members on insulator 50 can now be described. An insulator 50 having a uniform conductive layer supported by the first face 52 is obtained. This member can be obtained by fabrication such as placing a conductive layer on a standard insulator, or substrate 50 can be purchased part such as copper clad insulator board. Insulator 50 and the conductive layer may include an array of small apertures therethrough for use with electrical connections 100–112, as previously explained.

Next, the plurality of first electrode members are formed in the entire thickness of the conductive layer. The first electrode members are preferrably formed by first masking the conductive layer in the configuration of the plurality of first electrode members. In the apparatus of the preferred embodiment, first electrode mebers are in the form of sheet 56 having an array of apertures 58–69 therethrough. Therefore, for forming the apparatus of the preferred embodiment shown in FIGS. 2 and 3, the mask would have the same shape as a first electrode members, i.e. a sheet having an array of circular apertures therethrough.

The unmasked portion of the conductive layer is then etched such as by placing it in an acid bath. The acid will eat away, or remove, or etch the portion of the conductive layer which is not masked, exposing face 52 of insulator 50, and will leave the conductive layer covered by the masking intact. Since the masking is in the same configuration as the first electrode members, when the masking is removed, the conductive layer is patterned in the form of the first electrode members.

An alternate method of forming the first electrode member would be to obtain a thin conductive sheet. Apertures 58–69 can be punched in the conductive sheet and the punched sheet can be affixed to face 52 by any suitable method, such as by gluing.

The plurality of second electrode members 72–83 can then be formed on face 52 within and spaced from apertures 58–69. Two preferred methods of simultaneously forming second electrode members 72–83 will now be described. The first method would be to print conductive material down into and within and spaced from apertures 58–69 in sheet 56 on face 52 of insulator 50. Any suitable apparatus such as a conventional letter press (not shown) may be used to print the conductive material. A printing plate would be fabricated having the desired pattern of second electrode members and inked with conductive ink. The plate may be magnesium, for example, with the desired pattern formed by etching or any other conventional method known in the art.

A second method would be to screen conductive material down into and within and spaced from apertures 58–69 in sheet 56 on face 52 of insulator 50. Conventional screen printing apparatus (not shown) may be used in which a screen, such as stainless steel mesh, has a screening emulsion formed thereon. The emulsion has openings conforming to the desired electrode pattern and conductive ink is applied to the screen which is then laid over the conductive pattern. A squeegee is then passed over the screen to press the inked screen portions onto the substrate to deposit the second electrodes. Such techniques are well known in the art.

An alternate method of forming insulator component 42 would be to obtain an insulator 50 including a first face 52. A conductive layer of a uniform thickness in the pattern of sheet 56 having apertures 58–69 formed therein and also of second electrode members 72–83 can then be formed on face 52 by various suitable methods. For example, the uniform height conductive layer could be formed on insulator 50 by masking and etching the conductive sheet in a similar manner to that previously described in forming apertures 58–69, or by printing or screening the entire pattern in the manner described above. One of the pluralities of electrode members can then be thickened by plating. For example, in the preferred method, electrical connection can be made to sheet 56 only. Since electrode members 72–83 are electrically insulated from sheet 56, only sheet 56 will be plated such that the height of the first electrode members will then be greater than the height at second electrode members 72–83. If it is desired that electrodes 72–83 be plated rather than sheet 56, or if the first electrode members are electrically insulated from each other rather than electrically connected to each other as shown, it may be necessary to mask the areas not desired to be plated or have selective electrical connection to the areas desired to be thickened by plating.

In the preferred embodiment, the thickness of sheet 56 is greater than the thickness of second electrode members 72–83. Therefore, the height of the top surface of the plurality of first electrode means is vertically spaced above the height of the top surface of the plurality of second electrode members 72–83, best illustrated in FIG. 3.

Conductors 85–97 can then be fabricated on face 54 of insulator 50. Conductors 85–97 in the preferred embodiment are printed on face 54. Conductors 85–97 can also be formed by etching a conductive layer located on face 54 at the same time that the conductive layer on face 52 is etched or conductors 85–97 can be formed on face 54 by any other method known in the art.

Electrical connections 100–112 can then be made between sheet 56 and electrodes 72–83 and conductors 85–97, respectively.

Many extensions and variations of the present invention will be obvious to one having ordinary skill in the art. For example, although the plurality of first electrode members are shown in the form of material located around apertures 58–69 of conductive sheet 56, such that the first electrode members are electrically connected to each other, other forms of electrodes, such as donut shaped electrodes may be used thereby allowing the first electrode members to be electrically insulated from each other.

Although twelve individual switching units are shown and described, it will be apparent to one skilled in the art that apparatus 10 may optionally include more or fewer individual switching units. It will also be apparent that other variations of switch electrode patterns will be known to those skilled in the art, such as multiple electrode members including various types of sequencing, encoding, or other switch features.

The particular dimensions of the preferred embodiment are set out to particularly disclose the preferred and optimized embodiment thereof. It is envisioned that other dimensions for the various parts of the present invention are within the skill of the art.

The invention disclosed herein may be embodied in other specific forms and methods without departing from the spirit or the general characteristics thereof. The embodiments described herein are to be considered in all respects illustrative and not restrictive. The scope of the invention is indicated by the impended claims, rather than by the foregoing description and all changes which come within the meaning and range of equivalency of the claims are intended to be embraced therein.

I claim:

1. Method of forming electrode means having a height differential on an insulator to form a touch sensitive electronic switch including: an insulator having a first face; a plurality of first electrode means supported on the first face of the insulator and having a top surface; a plurality of second electrode means supported on the first face of the insulator and having a top surface, with the height of the top surface of the plurality of first electrode means being vertically spaced from the height of the top surface of the plurality of second electrode means, with the plurality of first electrode means being electrically insulated from the plurality of second electrode means, and with plurality of first electrode means and the plurality of second electrode means forming an array of individual switching units for use in a touch sensitive electronic keyboard switch, said method comprising:

a. obtaining an insulator having a first face with at least the first face supporting a conductive layer;

b. forming a pattern of first electrode means in the entire thickness of the conductive layer including apertures therethrough which expose the first face of the insulator; and c. forming a pattern of second electrode means of a thickness unequal to the thickness of the conductive layer on the first face of the insulator within and spaced from at least one of the apertures exposing the first face of the insulator.

2. The method of claim 1 wherein the step of forming the second electrode means comprises: forming the plurality of second electrode means to a thickness less than the thickness of the conductive layer on the first face of the insulator.

3. The method of claim 2 wherein the step of forming the first electrode means comprises:

masking the conductive layer on the insulator in the shape of the pattern of the first electrode means; and etching the masked, conductive clad insulator to remove the conductive layer not covered by the masked pattern and to leave the conductive layer covered by the masked pattern to form the first electrode means.

4. The method of claim 3 wherein the step of forming the second electrode means comprises printing conductive material down into, within, and spaced from the apertures which expose the first face of the insulator.

5. The method of claim 3 wherein the step of forming the second electrode means comprises screening conductive material down into, within, and spaced from the apertures which expose the first face of the insulator.

6. The method of claim 3 wherein the step of masking the conductive layer further comprises masking the conductive layer in the form of a sheet having an array of circular apertures therethrough.

7. The method of claim 2 wherein the step of forming the second electrode means comprises printing conductive material down into, within, and spaced from the apertures which expose the first face of the insulator.

8. The method of claim 2 wherein the step of forming the second electrode means comprises screening conductive material down into, within, and spaced from the apertures which expose the first face of the insulator.

9. The method of claim 1 wherein the step of forming the first electrode means comprises:

masking the conductive layer on the insulator in the shape of the pattern of the plurality of first electrode means; and etching the masked, conductive clad insulator to remove the conductive layer not covered by the masked pattern and to leave the conductive layer covered by the masked pattern to thus form the plurality of first electrode means.

10. The method of claim 9 wherein the step of forming the second electrode means comprises printing conductive material down into, within, and spaced from the apertures which expose the first face of the insulator.

11. The method of claim 9 wherein the step of forming the second electrode means comprises screening conductive material down into, within, and spaced from the apertures which expose the first face of the insulator.

12. The method of claim 9 wherein the step of masking the conductive layer further comprises masking the conductive layer in the form of a sheet having an array of circular apertures therethrough.

13. The method of claim 1 wherein the step of forming the second electrode means comprises printing conductive material down into, within, and spaced from the apertures which expose the first face of the insulator.

14. The method of claim 1 wherein the step of forming the second electrode means comprises screening conductive material down into, within, and spaced from the apertures which expose the first face of the insulator.

15. The method of claim 1 wherein the step of forming the first electrode means comprises:

punching the conductive layer to form an array of apertures corresponding to the individual switching units; and attaching the conductive layer to the first face of the insulator.

16. The method of claim 15 wherein the step of forming the second electrode means comprises printing conductive material down into, within, and spaced from the apertures which expose the first face of the insulator.

17. The method of claim 15 wherein the step of forming the second electrode means comprises screening conductive material down into, within, and spaced from the apertures which expose the first face of the insulator.

18. The method of claim 15 wherein the step of forming the second electrode means comprises simultaneously forming the plurality of second electrode means of a thickness less than the thickness of the conductive layer on the first face of the insulator.

19. The method of claim 18 wherein the step of forming the second electrode means comprises printing conductive material down into, within, and spaced from the apertures which expose the first face of the insulator.

20. The method of claim 18 wherein the step of forming the second electrode means comprises screening conductive material down into, within, and spaced from the apertures which expose the first face of the insulator.

21. The method of claim 1 wherein the steps of forming the first and second electrode means comprises:

simultaneously patterning the conductive layer in the shape of both the first electrode means and also the second electrode means; and plating up one of the first and second electrode means.

22. The method of claim 21 wherein the step of patterning the conductive layer comprises:

masking the conductive layer on the insulator in the shape of the pattern of the first and second electrode means; and etching the masked, conductive clad insulator to remove the conductive layer not covered by the masked pattern and to leave the conductive layer covered by the masked pattern to thus form the first and second electrode means.

23. The method of claim 21 wherein the step of patterning the conductive layer comprises printing the conductive layer in the pattern of the first and second electrode means.

* * * * *

UNITED STATES PATENT AND TRADEMARK OFFICE

CERTIFICATE OF CORRECTION

PATENT NO. : 3,981,757

DATED : September 21, 1976

INVENTOR(S) : Willis August Larson

It is certified that error appears in the above-identified patent and that said Letters Patent are hereby corrected as shown below:

In the title block, the assignee should read --Magic Dot, Inc., Minneapolis, Minnesota, a corporation of Delaware-- instead of "Globe-Union Inc., Wisconsin"

Signed and Sealed this

Seventh Day of December 1976

[SEAL]

*Attest:*

RUTH C. MASON
*Attesting Officer*

C. MARSHALL DANN
*Commissioner of Patents and Trademarks*